United States Patent [19]

Van Bogaert

[11] Patent Number: 4,850,398

[45] Date of Patent: Jul. 25, 1989

[54] DEVICE FOR SUPPLYING A WEFT THREAD TO A MAIN BLOWER OF AN AIR JET WEAVING LOOM

[75] Inventor: Philippe Van Bogaert, Brussels, Belgium

[73] Assignee: Picanol N. V., Ypres, Belgium

[21] Appl. No.: 186,287

[22] Filed: Apr. 26, 1988

Related U.S. Application Data

[62] Division of Ser. No. 940,971, Dec. 12, 1986.

[30] Foreign Application Priority Data

Dec. 13, 1985 [NL] Netherlands ..... 8503439

[51] Int. Cl.[4] ..... D03D 47/30

[52] U.S. Cl. ..... 139/435

[58] Field of Search ..... 139/435, 452; 226/97

[56] References Cited

U.S. PATENT DOCUMENTS

| | | | |
|---|---|---|---|
| 3,482,606 | 12/1969 | Mizuno et al. | 139/435 |
| 3,853,151 | 12/1974 | Van Donk | 139/435 |
| 3,871,421 | 3/1975 | Pfarrwaller | 139/435 |
| 4,369,817 | 1/1983 | Mizuno | 139/435 |
| 4,542,772 | 9/1985 | Gaschutz | 139/435 |

FOREIGN PATENT DOCUMENTS

| | | | |
|---|---|---|---|
| 129386 | 12/1984 | European Pat. Off. | 139/190 |
| 3204007 | 8/1983 | Fed. Rep. of Germany . | |
| 2144776 A | 3/1985 | United Kingdom . | |

*Primary Examiner*—Henry S. Jaudon

*Attorney, Agent, or Firm*—Bacon & Thomas

[57] ABSTRACT

A weft thread is inserted in a fluid jet loom by accelerating the weft thread to its insertion speed before the thread reaches the outlet of the main blower nozzle. The thread is accelerated to its insertion speed, for example, by an auxiliary nozzle upstream of the main blowing nozzle of the loom. Multiple weft threads may be inserted in a fluid jet loom by feeding each weft thread from a different supply source to individual weft thread supply channels and thereafter placing selected supply channels in communication with a through channel in a movable conduit block that selectively establishes communication between a single weft thread supply channel and the main blower nozzle. The conduit block can be mounted for various different movements to effect weft thread communication with the main blower.

11 Claims, 2 Drawing Sheets

DEVICE FOR SUPPLYING A WEFT THREAD TO A MAIN BLOWER OF AN AIR JET WEAVING LOOM

This application is a division of application Ser. No. 940,971, filed Dec. 12, 1986.

FIELD OF THE INVENTION

This invention relates to a device for supplying a weft thread to the main weft thread blower of an air jet weaving loom, in particular a weft supplier arranged to selectively feed multiple weft threads to the main weft blower of the loom.

BACKGROUND OF THE INVENTION

As is already known, in the case of multi-color weaving in an air jet loom, each of the different colored yarns is supplied with a separate main blower at the weft thread supply side of the loom. Each main blower is moved according to a specific pattern to enable the introduction of a weft thread having a specific color into the loom shed. Clearly, such movable main blowers are not suitable for high speed weaving operations because of the inertia of the moving mechanical parts.

It is also known to use multiple fixed main blowers for injecting multiple weft threads with each blower having its outlet facing the shed entrance. This construction is only suitable in the case where two main weft blowers are used.

In order to provide a solution to the problem of introducing multiple weft threads in a high speed air jet weaving loom, this invention contemplates a device for supplying multiple weft threads to a single main blower wherein the blower need not be moved to a great extent and wherein inertia forces resulting from movement of the moving parts remains quite limited.

SUMMARY OF THE INVENTION

This invention comprises essentially two or more supply channels for receiving weft threads from the weft supply; a single main blower for introducing the weft threads into the loom shed; and adjustable conduit block located upstream of the main blower and including one or more through channels which connect the supply channels with the main blower. The conduit block is movable to direct different weft threads to the main blower.

According to the preferred embodiment, the conduit block is rotatable around the axis of symmetry of the main blower. Other embodiments are also contemplated, including sliding and pivoting conduit blocks.

The present invention also contemplates a method for introducing weft threads into the loom shed whereby the weft threads are provided with a head start before reaching the main blower nozzle.

BRIEF DESCRIPTION OF THE DRAWINGS

To illustrate the invention, the appended drawings are provided, in which.

DESCRIPTION OF THE PREFERRED EMBODIMENTS OF THE INVENTION

Figure 1:
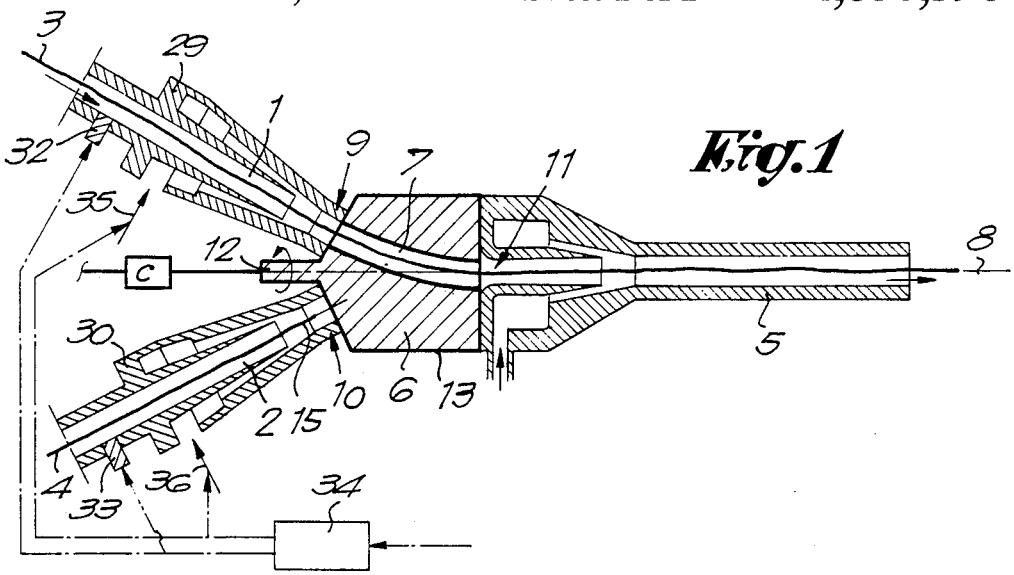
FIG. 1 shows a main blower for an air jet loom and a conduit block embodying the invention for supplying multiple weft threads to the main blower.

With reference to FIG. 1, an embodiment of the invention comprises a pair of weft thread supply channels 1 and 2 arranged to receive weft threads 3 and 4. A main blower 5 for the loom is located adjacent the loom shed (not shown) and downstream of the supply channels 1 and 2, and a conduit block 6 having a single through channel 7 provides communication between the outlet ends 9, 10 of the supply channels 1, 2 and the inlet end 11 of the main blower 5. Preferably, the conduit block 6 is arranged to rotate about the axis of symmetry 8 of the main blower 5 while providing communication between the channels 1, 2 and the blower 5. The channel 7 is disposed in the conduit block 6 in such a way that rotation of the block achieves quick connection between the ends 9, 10 of the supply channels 1, 2 and the inlet 11 of the main blower.

Appropriate control means C under the overall control of the loom control system are provided to control movement of the block 6. In this example, control C effects rotational movement of block 6 to move the through channel 7 into different positions whereat communication is provided between outlet ends 9, 10 of channels 1, 2 and the inlet 11 of blower 5. Controller C may be of various kinds, for example a motion transmitter on a shaft end 12 connected to the block 6. Alternatively, the motion transmitter may comprise a driving mechanism located on the outside wall of the block (not shown). The drive system for the motion transmitter C may be electrical, electromagnetic, pneumatic or mechanical.

Figure 2:
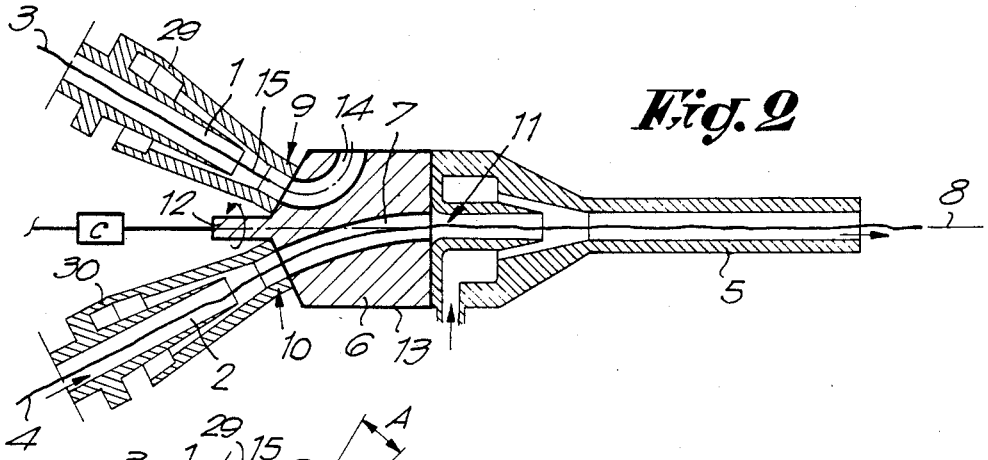
FIGS. 2–6 show alternate arrangements of the conduit block and different movements of the conduit block that can be utilized for supplying multiple weft threads to the main blower.

An alternate embodiment of the control block 6 is illustrated in FIG. 2, wherein the weft supply channel 1, 2 not connected to the inlet 11 of the main blower 5 via channel 7 is placed in communication with the ambient atmosphere by means of a venting channel 14 in block 6. In this manner, it is possible to supply a continuous air jet in the supply channels 1 and 2 so that the free end 15 of the waiting weft thread 3 or 4 is kept in drawn or taut position. Preferably, the air stream used to keep the weft thread taut may be much smaller than the air stream used for weft insertion.

Figure 3:
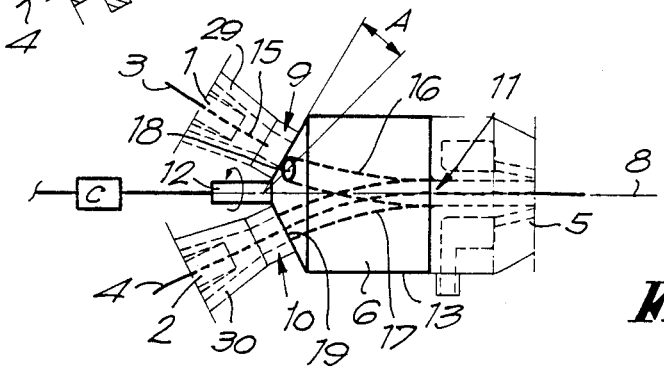

In FIG. 3, still another embodiment of the block 6 is illustrated wherein several channels 16 and 17 are provided in the block. The channels 16, 17 discharge into the inlet 11 of the main blower 5. Only one weft supply channel 1, 2 communicates with a single channel 16, 17 at one time and this construction is advantageous because, when the yarn supply is changed, the conduit block only rotates a small angle A between the desired supply channel 1, 2 and the closest desired conduit block channel 16, 17. Unlike the embodiment according to FIG. 1, the conduit block in accordance with FIG. 3 need not rotate 180°. Preferably, the inlets 18, 19 of channels 16, 17 that are not connected to the supply channels may be closed by means not shown so that pressure loss in the channel 17 created by the distcharge of air along channel 16 and inlet 18 is avoided.

Figure 4:
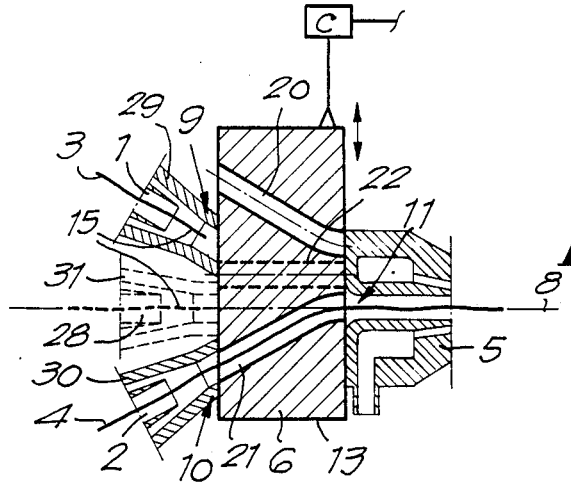

FIG. 4 illustrates still another embodiment of the conduit block 6 wherein the block 6 is mounted for sliding (reciprocal) motion. The sliding direction is preferably in a plane normal to the axis of symmetry 8 of the main blower 5. In this instanct, several through channels 22, 22 in block 6 may be provided.

Figure 5:
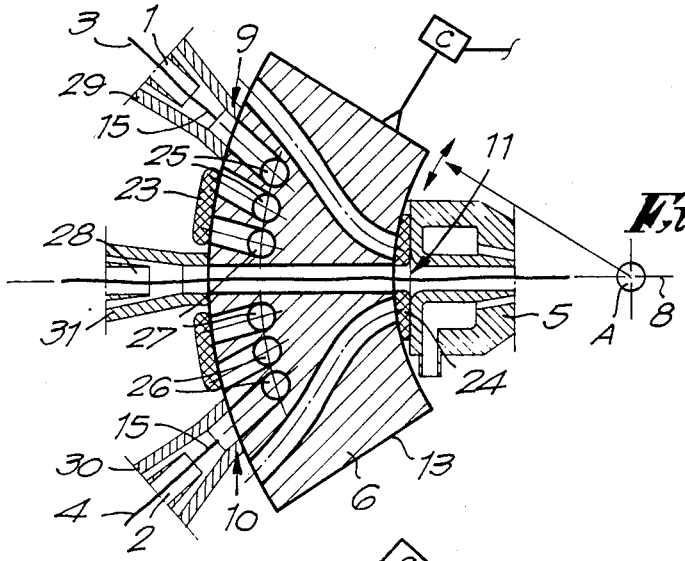

In FIG. 5, the block 6 is moved by pivoting, for example, between guides 23, 24, preferably about an axis A intersecting the blower axis 8. Clearly, vent openings 25, 26, 27 are contemplated wherein venting occurs toward the side of the block 6.

Figure 6:
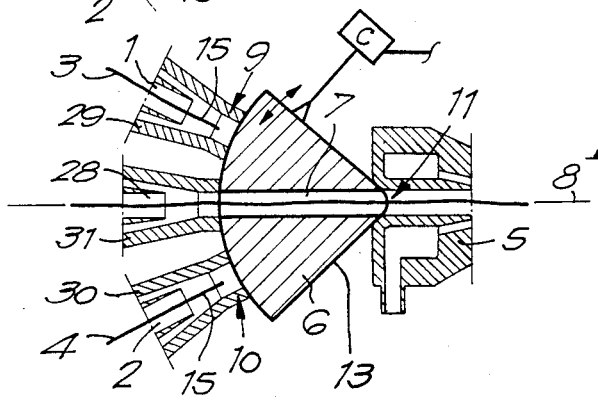

In FIG. 6, the block 6 is provided with only one through channel 7 and is pivotally mounted like the FIG. 5 embodiment to effect the supply of different threads to the main blower 5.

The number of supply channels 1, 2 may be larger than two in number. In the embodiments illustrated in FIGS. 4–7, three supply channels 1, 2 and 28 have been provided.

The supply channels 1, 2 and 28 preferably comprise the outlets of weft thread air blowers 29, 30 and 31 having blowing air supplier jets 35, 36.

As illustrated in FIG. 1, reciprocating thread squeezing or retaining devices 32, 33 may be mounted in the supply channels 1 and 2, for instance before or after the blowers 29, 30. In such case, it is not necessary that the conduit block 6 be equipped with a venting channel such as 14 in FIG. 2 because the thread can be kept in drawn or taut condition by appropriate actuation of these thread squeezing devices 32, 33. As illustrated, thread squeezing devices 32, 33 move towards and away from weft threads 3, 4 to selectively lock the thread against the side wall of the supply channel 1, 2.

Additional means, not shown, may be provided in the various supply channels 1, 2 of the weft threads 3, 4 to effect a pull-back motion of the free end 15 of the waiting weft thread over a predetermined distance. Such pull-back or retraction means may be of various suitable kinds and they insure that the leading ends of the weft threads 3, 4 are not caught between the ends 9, 10 of supply channels 1, 2 and the block 6.

Also, where venting channels in the wiring block 6 are provided, a small clearance opening may be kept between the ends 9 and 10 of the supply channels 1 and 2 and the block 6 to avoid catching and holding the weft thread between the block 6 and ends 9, 10 of supply channel 1, 2.

The functioning of all the devices described hereinabove can be understood with reference to the drawings. For example, in FIG. 1, weft thread 3 in supply channel 1 has been directed to main blower 5 via through channel 7 in block 6, while weft thread 4 in channel 2 waits its turn for admission to the through channel 7. In FIG. 2, weft thread 4 has been delivered to main blower 5 via through channel 7 in block 6, while the end 15 of weft thread 3 awaits its time for delivery to the blower 5. In this condition, venting of a small air jet through vent 14 keeps the end 15 of weft thread 3 in taut condition. The supply of the different weft threads 3, 4 to the main blower 5 is controlled by the rotary position of condition block 6 as will be readily understood with reference to and by comparison between FIGS. 1 and 2. FIGS. 3–6 show other moving arrangements for the control block 6 whereby minimum motion of the block is required to deliver different weft threads to the main blower 5.

This invention also contemplates a method for supplying weft thread into the shed of an air jet loom whereby the acceleration of the weft thread occurs in advance of the outlet of the main blower 5 of the loom. Acceleration of the weft thread is achieved in such a manner that the free end 15 of the weft thread passes the outlet of the main blower 5 just at the moment of the scheduled insertion phase of the weft thread into the loom shed. The speed of the weft should be equal at this moment to the required insertion speed of the weft thread. In this manner, a truly "flying start" of the weft thread is achieved with the advantage that a huge time saving is effected and weaving at high speed is made possible. According to this method, the required speed of the weft thread can be achieved in the blowers 29, 30. Preferably, an actuating unit 34 is provided in order to enable the weft threads 3, 4 to start their motion at the right moment so that their free ends, i.e., end 15, reach the outlet of the main blower 5 at the precise time called for in accordance with the weft thread insertion schedule. The actuating unit 34 can be coupled, for instance, with the thread holding devices 32 and 33, or with the air supply, respectively 35 and 36, of the blowers 29 and 30, and possibly 31, which are located upstream of block 6.

Clearly, the main blowers and the upstream thread blowers may be of any suitable kind known to those skilled in the art.

The present invention is by no means limited to the specific illustrated embodiments and the invention could be constructed in any suitable form capable of carrying out the objectives of the invention as described herein.

I claim:

1. In a method for inserting a weft thread into a shed of a fluid jet loom using a main blower nozzle, the improvement comprising supplying the weft thread to the main blower nozzle and accelerating the weft thread within the main blowing nozzle to its insertion speed so that the weft thread reaches its insertion speed before the leading end of the weft thread reaches the outlet of the main blower nozzle.

2. In a method for inserting a weft thread into a shed of a fluid jet loom using a main blower nozzle, the improvement comprising supplying the weft thread to the main blower nozzle and accelerating the weft thread to its insertion speed such that the weft thread reaches its insertion speed at the moment that the leading end of the weft thread reaches the outlet of the main blower nozzle.

3. In a method for inserting a weft thread into a shed of a fluid jet loom using an auxiliary blower nozzle moving each weft thread in a weft supply channel, a conduit block for receiving each weft thread and a main blower nozzle in communication with the conduit block, the improvement comprising accelerating each weft thread by means of its respective auxiliary blower nozzle in its respective weft supply channel through the conduit block and into the main blower so that the weft thread reaches its insertion speed before the leading end of the weft thread reaches the outlet of the main blower nozzle.

4. In a method for inserting a weft thread into a shed of a fluid jet loom using an auxiliary blower nozzle moving each weft thread in a weft supply channel, a conduit block for receiving each weft thread and a main blower nozzle in communication with the conduit block, the improvement comprising accelerating each weft thread by means of its respective auxiliary blower nozzle in its weft supply channel through the conduit block and into the main blower such that the weft thread reaches its insertion speed at the moment that the leading end of the weft thread reaches the outlet of the main blower nozzle.

5. A process of inserting a weft thread in a fluid jet loom shed from multiple supply means through a single main blower having a blower axis comprising:

feeding each weft thread from a different supply means to individual weft thread supply channels;

placing each weft thread supply channel adjacent a movable conduit block having at least one through channel having its outlet in fluid communication with the inlet of the main blower and its inlet adjacent the weft thread supply channels;

moving the conduit block to selectively place a desired weft thread supply channel in communication with the said conduit block through channel while effectively blocking all other weft thread supply channels from communication with said through channel.

6. A process as claimed in claim 5, wherein the conduit block moving step is carried out by rotating the conduit block about an axis substantially paralle with the main blower axis.

7. The improvement in a process as recited in claim 5, wherein the conduit block moving step is carried out by laterally translating the conduit block relative to the main blower axis.

8. The improvement in a process as claimed in claim 5, wherein the conduit block moving step is carried out by pivoting the conduit block about an axis intersecting the main blower axis.

9. The improvement in a process as claimed in claim 5, the improvement further including positioning weft threads in the weft thread supply channels by auxiliary blowers and venting non-desired weft thread supply channels to atmosphere while a desired weft thread supply channel is in communication with the conduit block through channel.

10. The improvement in a process as claimed in claim 9, including accelerating each inserted weft thread by the respective auxiliary blower in its weft supply channel through the conduit block and into the main blower such that the weft thread reaches its insertion speed before the leading end of the weft thread reaches the outlet of the main blower.

11. The improvement in a process as claimed in claim 9, including accelerating each inserted weft thread by the respective auxiliary blower in its weft supply channel through the conduit block and into the main blower so that the weft thread reaches its insertion speed at the moment that the leading end of the weft thread reaches the outlet of the main blower.

* * * * *